United States Patent [19]

Lemire

[11] Patent Number: 4,954,374

[45] **Date of Patent: * Sep. 4, 1990**

[54] DECORATIVE MODULE HAVING A CONCAVE FACE

[76] Inventor: Gilbert Lemire, 1565 Victoria, Suite 209, St-Lambert, Quebec, Canada, J4R 1R6

[ * ] Notice: The portion of the term of this patent subsequent to Feb. 21, 2006 has been disclaimed.

[21] Appl. No.: 289,235

[22] Filed: Dec. 23, 1988

Related U.S. Application Data

[63] Continuation-in-part of Ser. No. 136,946, Dec. 23, 1987, Pat. No. 4,806,403.

[51] Int. Cl.[5] ..... B65D 5/26

[52] U.S. Cl. ..... 428/34.1; 52/222; 428/174; 428/542.8

[58] Field of Search ..... 40/154, 155; 52/222, 52/406; 229/115, 116; 428/34.1, 174, 542.8

[56] References Cited

U.S. PATENT DOCUMENTS

| | | | |
|---|---|---|---|
| D. 247,276 | 2/1978 | Smith | D6/310 |
| D. 268,316 | 3/1983 | Shamoon | D6/300 |
| 1,379,612 | 5/1921 | Baver | 428/542.8 X |
| 2,806,310 | 9/1957 | Boyd | 428/14 X |
| 2,862,322 | 12/1958 | Ziegler | 40/154 |
| 4,212,124 | 7/1980 | Gammill | 40/154 X |
| 4,232,075 | 11/1980 | Gantz et al. | 428/913 X |
| 4,274,616 | 6/1981 | Radtke | D6/310 X |
| 4,371,575 | 2/1983 | Kerk et al. | 428/81 |
| 4,515,149 | 5/1985 | Sgroi et al. | 165/178 X |
| 4,523,405 | 6/1985 | Madonia | 428/174 X |
| 4,611,429 | 9/1986 | Kanies | 49/475 X |
| 4,660,323 | 4/1987 | Kanies | 49/475 X |
| 4,806,403 | 2/1989 | Lemire et al. | 428/174 X |

*Primary Examiner*—Henry F. Epstein

*Attorney, Agent, or Firm*—Oblon, Spivak, McClelland, Maier & Neustadt

[57] ABSTRACT

There is disclosed a decorative module which can be used to decorate the face of a building. The decorative module is made of a single sheet of material, such as aluminum, and comprises a rectangularly shaped concave face derived from an intermediate portion of the sheet of material. The concave face forms an arc of a circle whose height is at least 1/25th the length of the chord of the arc of a circle. The module is constructed and arranged to be self-supporting. The module is formed with an inwardly angled border including an outward extension defining therewith a female end, and an outwardly angled border defining a male end capable of engagement with the female end. The module can be affixed to a surface by means of the outward extension.

12 Claims, 4 Drawing Sheets

DECORATIVE MODULE HAVING A CONCAVE FACE

CROSS REFERENCE

This application is a continuation-in-part of application No. 136,946 filed Dec. 23, 1987, now U.S. Pat. No. 4,806,403 issued Feb. 21, 1989.

BACKGROUND OF INVENTION (a) Field of the Invention

The present invention relates to a decorative module. More particularly, the present invention is concerned with a unit which can be used to decorate the face of a building or the like. The unit according to the invention has also been found very convenient to be used as a canvas for a painting or the like.

(b) Description of Prior Art

It is well known that the field of decoration offers practically unlimited possibilities in terms of the materials used to produce a new effect. On the other hand, it is also known that aluminum and its alloys constitute a material of choice because they are relatively easy to work and do not oxidize rapidly.

In a slightly different line of thought, it was considered that a new decorative module would constitute an excellent support for a picture or a painting or the like, as a replacement for the standard canvas which has been in common use for ages.

The prior art has revealed a few designs based on the above ideas, but none of them can achieve the results which are obtained when utilizing the decorative module according to the present invention. This prior art is the following:

U.S. Pat. No. 2,862,322 Ziegler
U.S. Pat. No. 2,806,310 Boyd
U.S. Pat. No. 1,379,612 Baver
U.S. Design Pat. No. 268,316 Shamoon
U.S. Design Pat. No. 247,276 Smith.

SUMMARY OF INVENTION

The present invention relates to a decorative module made of a single sheet of material, which comprises a rectangularly shaped concave face derived from an intermediate portion of the sheet of material. Rearwardly directed angle borders are formed along two opposite sides of the concave face, and means are provided to enable any remaining portion of the sheet of material extending past the angled borders to fold at the rear of the concave face. The latter forms an arc of a circle whose height is at least 1/25th the length of the chord of the arc of a circle. The module is constructed and arranged to be self-supporting and capable of being applied against an outer surface by fixation of the remaining portion thereto.

The present invention also relates to a decorative module made of a single sheet of material, which comprises a rectangularly shaped concave face derived from an intermediate portion of the sheet of material. Rearwardly and inwardly angled borders are formed along two opposite sides of the concave face, and means are provided to enable the remaining portions of the sheet of material to fold at the rear of the concave face and to engage into one another to form a rigid structure. The concave face forms an arc of a circle whose height is at least 1/25th the length of the chord of the arc of a circle. The module is constructed and arranged to be self-supporting.

In accordance with a preferred embodiment of the invention, the concave face is derived from an off centered intermediate portion of the sheet of material. The remaining portions comprise a larger portion and a smaller portion and the larger portion folds over the smaller portion.

In accordance with another preferred embodiment of the invention, each angled border has a front edge and a rear edge, both edges being formed by bending the sheet of material along two different rectilinear parallel grooves formed therein, the rear edge being shorter than the front edge.

In accordance with another preferred embodiment of the invention, the decorative module comprises cuts made in the sheet of material from both sides of the latter, adjacent the opposite sides mentioned above. Each cut is aligned with one rear edge and reaches both ends thereof. The cuts enable to produce folds of the sheet of material parallel to the adjacent sides and perpendicularly to the rear edge. Each remaining larger and smaller portions are thereby formed with a pair of outer folds. The folds of the smaller portion is engaged by the folds of the larger portion, thus constituting the back of the decorative module.

In accordance with another preferred embodiment of the invention, the cuts define triangular portions with the ends of the front edges and the rear edges, and the triangular portion is inwardly bent against a corresponding angled border.

In accordance with another preferred embodiment of the invention, each border defines an acute angle with respect to the front face of the decorative module, and an obtuse angle with respect to the back thereof.

The decorative module can be made of any suitable material, but the preferred material is a metal, such as aluminum or alloys thereof.

The present invention also relates to a decorative module made of a single sheet of material, which comprises a rectangularly shaped concave face derived from an intermediate portion of the sheet of material. A rearwardly and inwardly directed angled border is formed along one side of the concave face to define a male end of the decorative module, and a rearwardly and outwardly directed angled border is formed along the other side of the concave face. Means are provided to enable the remaining portion of material to extend from the rearwardly and inwardly directed angled border to define therewith a female end of the decorative module capable of engaging the male end. The concave face forms an arc of a circle whose height is at least 1/25th the length of the chord of the arc of a circle.

BRIEF DESCRIPTION OF DRAWINGS

The invention will now be illustrated by means of the following drawings in which.

DESCRIPTION OF PREFERRED EMBODIMENTS

With reference to the drawings, it will be seen that the decorative module according to the invention is made from a single blank 1 which has a rectangular shape and will be prepared for bending and folding into the decorative module 3 according to the invention, in the following manner.

Figure 1:
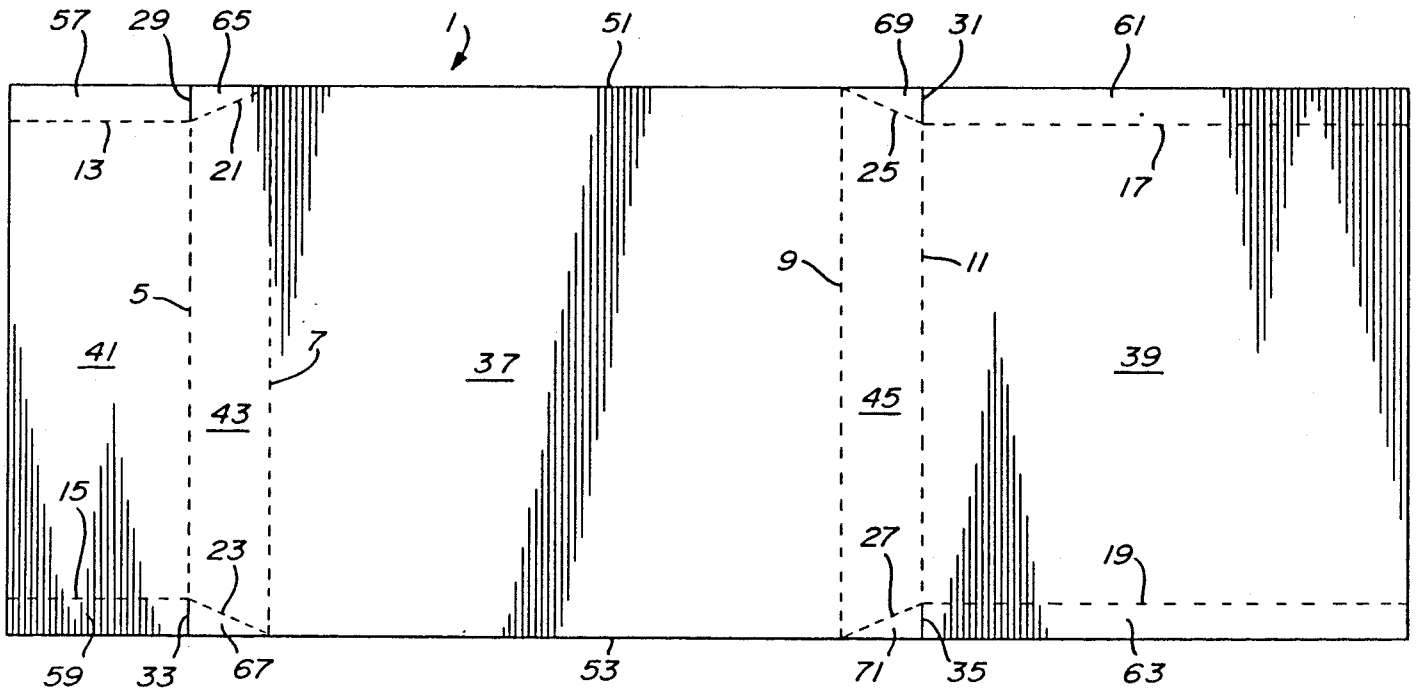
FIG. 1 is a view of the blank used to produce the decorative module according to the invention.
Figure 2:
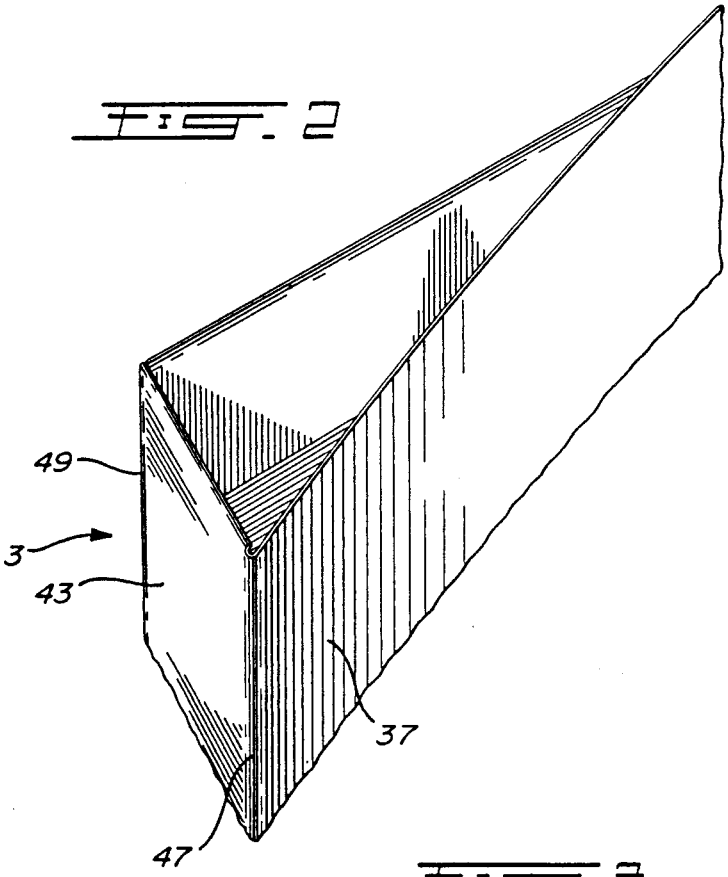
FIG. 2 is a partial perspective view showing a corner of the decorative module.
Figure 3:
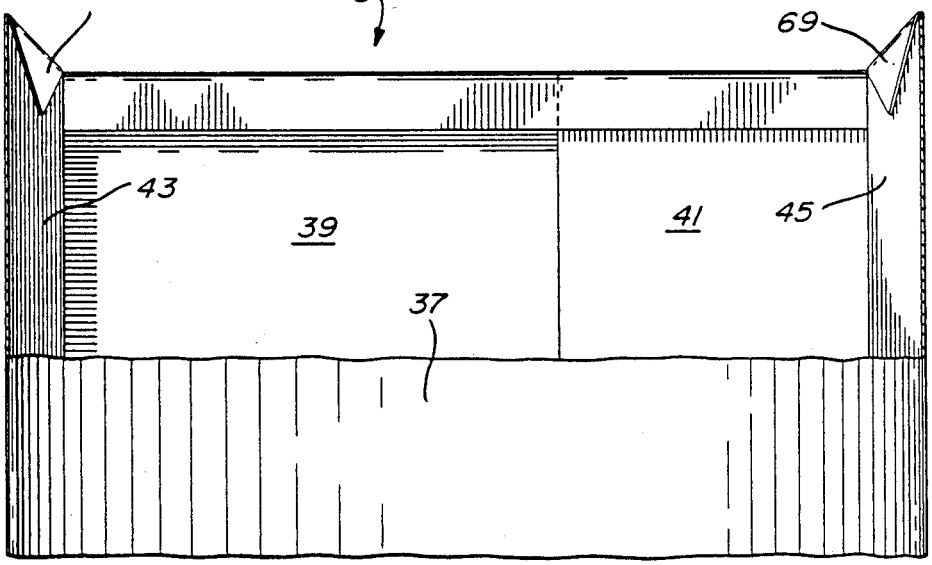
FIG. 3 is a front view with the concave face partly removed showing the inner structure of the decorative module according to the invention.

At the back of the sheet of aluminum 1 there are made in a manner known to those skilled in the art, rectilinear grooves 5, 7, 9, 11, 13, 15, 17, 19, 21, 23, 25 and 27. In addition, there are made four cuts, namely cuts 29, 31, 33 and 35. It should be noted that the cuts, 29, 31, 33, and 35, are made to reach exactly the respective junctions of grooves 5,13,21; 11,17,25; 5,15,23; and 11,19,27. With particular reference to FIGS. 2 and 3 of the drawings, it will be seen that the decorative module 3 according to the invention mainly consists of a rectangular shaped concave face 37, which, as seen from FIG. 1 of the drawings, is derived from an off centered intermediate portion of the sheet of material 1. The remaining portions of the sheet 1 obviously comprise a larger portion 39 and a smaller portion 41. As shown in FIG. 3 of the drawings, the larger portion folds over the smaller portion in a manner which will be explained more in details later.

The decorative module 3 also comprises angled borders 43 and 45 as particularly shown in FIGS. 2 and 3 which are formed along the two opposite edges 47,49 (FIGS. 2 and 3) of the concave face 37.

These angled borders 43,45 are formed by bending the sheet of material 1 along the two different rectilinear parallel grooves 7,9 and 5,11 formed in the sheet of material. As formed, each angled border 43,45 of the decorative module has a front edge 47 and a rear edge 49. It will be noted that only the front and rear edges of angled border 43 have been illustrated it being understood that the front and rear edges of the angled border 45 are exactly the same.

It has been mentioned above that cuts 29, 31, 33, 35 are made in the sheet of material. Reference is particularly made to FIG. 1 of the drawings for the particular location and arrangement of these cuts. It will be seen that these cuts are made in the sides 51 and 53 of the sheet of aluminum 1. With reference to FIG. 1, it will be seen that each cut is aligned with one rear edge 49 which coincides with a rectilinear groove 5,11 and reaches both ends of the rear edge. As shown in FIG. 1, these cuts 29, 31, 33, 35 will enable to produce folds 57, 59, 61, 63. These folds are formed by bending the sheet of material in the outer portions 39,41 respectively along rectilinear grooves 13, 15, 17, 19. Before proceeding to engage the outer portions 39,41 with one another in a manner which will be discussed later, it should be pointed out that the cuts 29, 31, 33, 35 define triangular portions 65, 67, 69, 71 with the ends of the front and rear edges of the angled borders 43,45. Before forming the decorative module, these triangular portions are inwardly bent against a corresponding angled border 43,45 in the manner shown particularly in FIG. 3 of the drawings at 65 and 67.

To give the decorative module its final shape, after having bent the sheet of material 1 along the rectilinear grooves in the manner indicated above, it is merely necessary to insert the outer portion 41 with the folds 57,59 already formed, into the folds 61,63 of the outer portion 39. This will provide an assembly which is self-contained, self-supporting and sufficiently rigid to keep its shape indefinitely.

Although the material of the sheet can vary to a large extent, it has been found that the best suitable material for this purpose is aluminum or an aluminum alloy. Of course, any other suitable sheet metal could be used.

In the model which has been illustrated, it will be noted that the concave face forms an arc of a circle. In this model, it has been found that the height of the arc of a circle is about 3 inches and that the chord is about 24 inches. It has been found, however, that the height could be as low as 1 inch while providing a structure which is suitable for the various uses according to the present invention.

Figure 4:
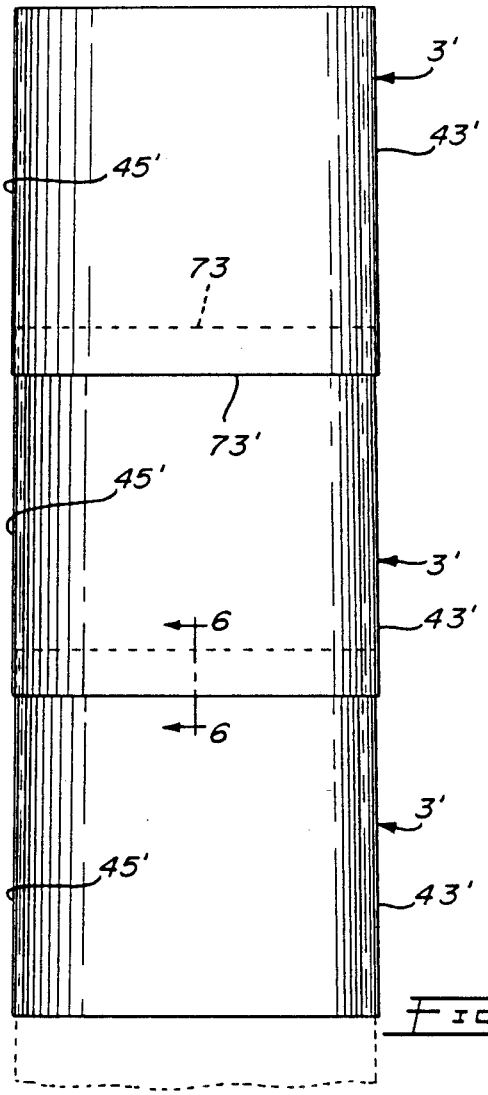
FIG. 4 is a front view showing the end to end connection of an alignment of decorative modules according to the invention.
Figure 6:
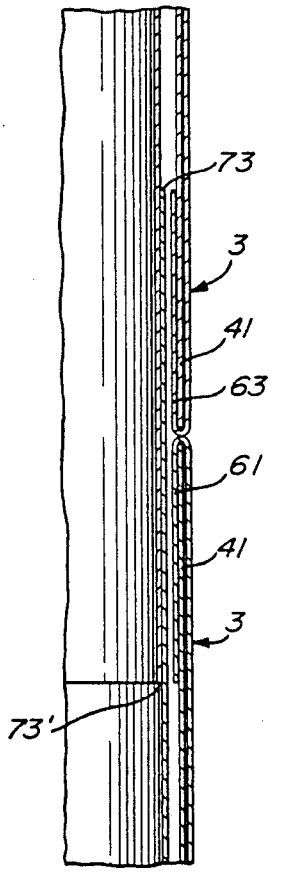
FIG. 6 is a section taken along line 6—6 of FIG. 4.
Figure 5:
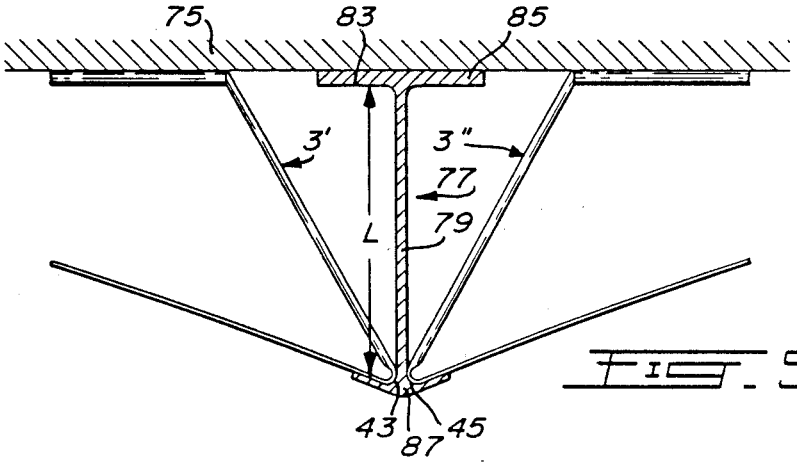
FIG. 5 is a cross-section view showing a bracket used for mounting decorative modules according to the invention in side by side relationship.
Figure 7:
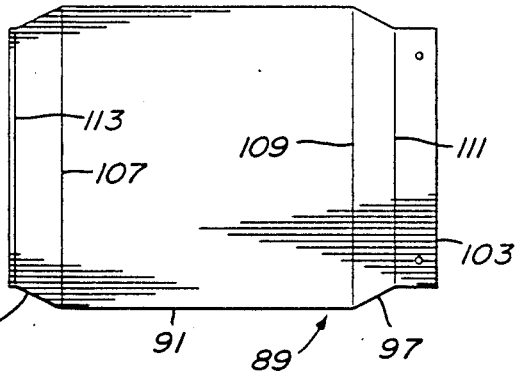
FIG. 7 is a view of a blank used to produce another module according to the invention.
Figure 8:
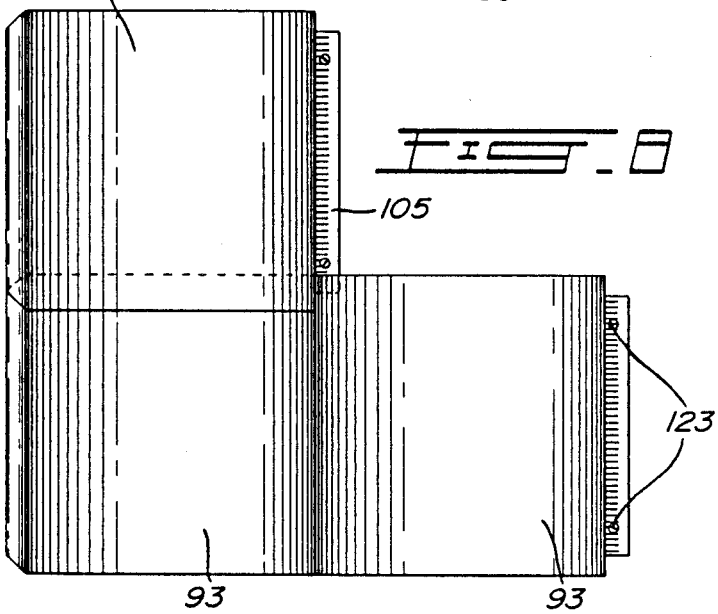
FIG. 8 is a front view showing the end to end and side to side connection of a plurality of decorative modules according to the embodiment illustrated in FIG. 7.

Turning now to FIG. 4, it will be seen that the decorative module 3' has slightly converging angled borders 43',45'. It will easily be realized that this arrangement will permit to align a series of decorative modules 3 in end to end relationship by embedding their adjacent ends 73,73' as particularly shown in FIG. 4.

This mounting of an alignment of decorative modules enables to use the module 3 according to the invention to decorate the outer face of a structure such as a building 75. To do so it is obviously necessary to provide an arrangement of side by side alignment of such modules. This is made possible by providing a bracket 77. The latter consists of a web portion 79 whose length L corresponds to the thickness of the decorative module 3' at the angle borders 43,45. The bracket 77 also comprises flanges 83,85, at one end, of standard construction enabling to mount the bracket against structure 75 in known manner. Finally, the bracket 77 is provided with V-shaped double catch 87 at the other end of the web 79. It will be seen that this double catch will engage oppositely facing angle borders 43,45 of two decorative modules 3',3" placed side by side by catching their outer edges.

According to a variant, the module may be as shown in FIGS. 7 to 10 inclusive in which case it is formed with an inwardly angled border including an outward extension defining therewith a female end, and an outwardly angled border defining a male end capable of engagement with the female end.

More particularly, with reference to FIGS. 7 to 10 of the drawings, it will be seen that as in the case of the previously described embodiment, the module is made from a single blank 89 which has a main rectangular portion 91 which is intended to constitute the concave face 93, two trapezoidal portions 95 and 97 from which the angled borders 99 and 101 are formed and a smaller rectangular portion 103 to constitute the remaining portion 105.

As in the case of the other embodiment rectilinear grooves 107, 109 and 111 are made at the back of the blank 89. In addition, another groove 113 is formed in the blank to enable to form a hook end 115 at the end of the angled border 99.

Figure 9:
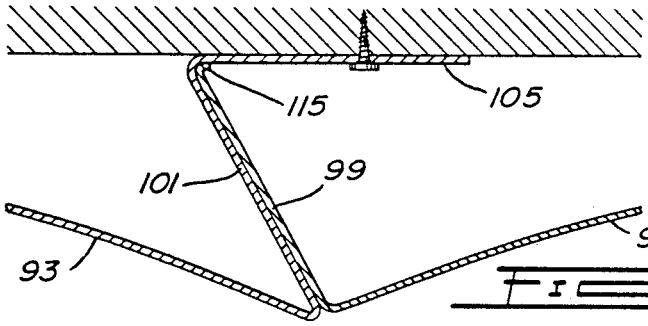
FIG. 9 is a cross-section view showing the edge to edge engagement of two adjacent modules according to the embodiment illustrated in FIG. 7.
Figure 10:
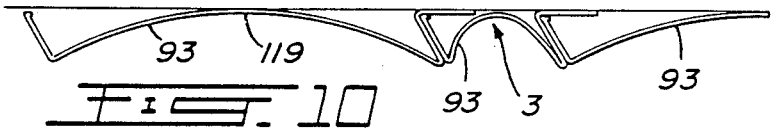
FIG. 10 is a schematic view showing the interconnection of a plurality of modules in which the width may vary.

It will therefore be seen that the angled border 99 is rearwardly and outwardly directed terminating with a hook portion 115, while the angled border 101 is rearwardly and inwardly directed. The remaining portion 105 folds outwardly, as shown in FIG. 9 according to a plane which is parallel to the tangent line 117 taken at the bottom 119 of the arc of a circle defined by the concave face 93.

Referring again to FIG. 9 of the drawings, it will be seen that the angled borders 99 and 101 define therebetween supplementary angles with respect to the surface 121 against which the modules 89 are affixed such as by screwing at 123. Finally, the male end defined by angled border 99 is shaped to be received within the female end defined by the angled border 101 and the remaining portion 105.

Of course, the decorative module according to the invention may lend itself to a plurality of other applications as it will readily be apparent to any one skilled in the art.

I claim:

1. A decorative module made of a single sheet of material, which comprises:

a rectangularly shaped concave face derived from an intermediate portion of said sheet of material;

a rearwardly and inwardly directed angled border formed along one side of said concave face to define a male end of said decorative module;

a rearwardly and outwardly directed angled border formed along the other side of said concave face;

means enabling remaining portion of said sheet of material to extend from said rearwardly and inwardly directed angled border to define therewith a female end of said decorative module capable of engaging said male end;

said concave face forming an arc of circle whose height is at least 1/25th the length of the chord of said arc of a circle;

so constructed and arranged that said module is self-supporting and capable of being applied against an outer surface by fixation of said remaining portion thereto.

2. A decorative module according to claim 1, wherein said angle borders define therebetween supplementary angles.

3. A decorative module according to claim 1, wherein said remaining portion folds outwardly according to a plane which is parallel to a tangent taken at the bottom of said arc of circle, said remaining portion and said rearwardly and inwardly directed angled border defining said female end, said female end to receive said rearwardly and outwardly directed angled border.

4. A decorative module according to claim 3, wherein said male end terminates into a hook portion to properly fit inside bottom of said female end.

5. A decorative module according to claim 1, wherein said concave face is derived from an off centered intermediate portion of said sheet of material.

6. A decorative module according to claim 5, wherein each angled border has a front edge and a rear edge, both said edges being formed by bending said sheet of material along two different rectilinear parallel grooves formed therein; said rear edge being shorter than said front edge.

7. A decorative module according to claim 6, which comprises cuts made in said sheet of material from both sides of said sheet of material adjacent said opposite sides, each said cut being aligned with one said rear edge and reaching both ends thereof, said cuts enabling to produce folds of said sheet of material parallel to said adjacent sides and perpendicularly to said rear edge, said remaining portion thereby being formed with an outer fold defining said female end.

8. A decorative module according to claim 7, which is metallic.

9. A decorative module according to claim 8, which is made of aluminum.

10. A decorative module according to claim 8, which is made of an aluminum alloy.

11. A decorative module according to claim 5, wherein said angled borders are slightly converging so as to permit a series of said decorative modules to be aligned end to end with their adjacent ends embedded into one another.

12. A structure decorated with a plurality of modules aligned as defined in claim 11.

* * * * *